United States Patent [19]

Suzuki

[11] Patent Number: 5,026,182

[45] Date of Patent: Jun. 25, 1991

[54] ROCKING MECHANISM FOR A RIBBON CASSETTE

[75] Inventor: Hiroshi Suzuki, Aichi, Japan

[73] Assignee: Brother Kogyo Kabushiki Kaisha, Japan

[21] Appl. No.: 488,689

[22] Filed: Mar. 5, 1990

[30] Foreign Application Priority Data

Mar. 3, 1989 [JP] Japan ..... 1-52575

[51] Int. Cl.[5] ..... B41J 35/28

[52] U.S. Cl. ..... 400/208; 400/240.3; 400/247

[58] Field of Search ..... 400/208, 208.1, 207, 400/216.1, 194, 240.3, 240.4, 247

[56] References Cited

U.S. PATENT DOCUMENTS

| | | | |
|---|---|---|---|
| 4,511,271 | 4/1985 | Oberto | 400/208 |
| 4,563,100 | 1/1986 | Hamamichi | 400/208 |
| 4,564,303 | 1/1986 | Rosenberg | 400/208 |
| 4,611,936 | 9/1986 | Yasui | 400/208 |
| 4,623,272 | 11/1986 | Kondo | 400/208 |
| 4,652,154 | 3/1987 | Horiya et al. | 400/208 |
| 4,697,942 | 10/1987 | Yagi et al. | 400/216.1 |
| 4,846,595 | 7/1989 | Kato et al. | 400/691 |
| 4,867,587 | 9/1989 | Kishida et al. | 400/208 |
| 4,884,907 | 12/1989 | Yasumi | 400/208 |

FOREIGN PATENT DOCUMENTS

| | | | |
|---|---|---|---|
| 0244228 | 4/1987 | European Pat. Off. . | |
| 2515899 | 10/1976 | Fed. Rep. of Germany | 400/208 |
| 0176085 | 10/1984 | Japan | 400/208 |
| 2091684 | 8/1982 | United Kingdom | 400/208 |
| 2156279 | 10/1985 | United Kingdom . | |
| 2171057 | 8/1986 | United Kingdom | 400/208 |

*Primary Examiner*—Eugene H. Eickholt

*Attorney, Agent, or Firm*—Kane, Dalsimer, Sullivan, Kurucz, Levy, Eisele and Richard

[57] ABSTRACT

In a ribbon cassette capable of being provided on a printing device including a rocking mechanism for rocking a ribbon cassette in a vertical direction, a protection portion provided on the ribbon cassette protects the ribbon cassette from being fit with the rocking mechanism. Thus, even if the rocking mechanism is operated, the ribbon cassette is not rocked. In other words, the ribbon cassette is not rocked even if a data for rocking the ribbon cassette is erroneously inputted to the printing device.

8 Claims, 6 Drawing Sheets

ROCKING MECHANISM FOR A RIBBON CASSETTE

BACKGROUND OF THE INVENTION

The present invention relates to a rocking mechanism employed in a printing device for rocking a ribbon cassette mounting a print ribbon in a vertical direction so that a desired printing zone is located to a printing position where the printing zone is opposed to a printing sheet on which a printing operation is executed.

Conventionally, in a printing device with such type rocking mechanism, the printing device is so arranged to be capable of detachably and attatchably providing a multiple zones ribbon cassette which houses a multiple zones ribbon where multiple printing zones with different colors are disposed in a width direction. The rocking mechanism is operated according to multiple color printing data outputted from a host machine. Thereby, one of the multiple zones is selected and the multiple zones ribbon cassette is rocked in a vertical direction, i.e., in a width direction so that the selected zone is opposed to a printing mechanism section for executing a printing operation with a color according to the selected zone.

In the printing device of this type, when single color printing data is outputted from the host machine, the multiple zones ribbon cassette is fixed in a vertical direction since a predetermined printing zone is opposed to the printing mechanism section according to the single color printing data and a single color printing operation is executed. Therefore, other printing zones are not used and are wasted. To prevent that, a single zone ribbon cassette housing a single zone ribbon which is provided with one printing zone in a width direction is used instead of the multiple zones ribbon cassette. The printing device prints data with a single color without a rocking operation.

However, when multiple color printing data is mistakenly outputted from the host machine while the single zone ribbon cassette is attached, since the printing device operates the rocking mechanism in accordance with the multiple color printing data having been inputted and the single printing zone is not opposed to the printing mechanism section, part of the printing operation is not executed on a printing sheet and the characters and/or symbols corresponding to the above mistaken printing operation are not printed on the printing sheet.

SUMMARY OF THE INVENTION

It is therefore an object of the invention to provide an improved rocking mechanism for a ribbon cassette capable of correctly executing a printing operation even if the multiple color printing data is outputted from the host machine when the single zone ribbon cassette is provided on the printing device.

For this purpose, according to the invention, there is provided a rocking mechanism, adapted to be positioned in a printing device, for rocking a ribbon cassette mounting a print ribbon being provided with at least one print zone divided in a width direction thereof, said rocking mechanism comprising:

drive member for driving said ribbon cassette to be rocked in a vertical direction; and transmit control portion, provided on said ribbon cassette, for transmitting a driving force of said drive member to said ribbon cassette, the inhibiting said transmission in case the number of said print zone provided on said print ribbon is a predetermined value.

DESCRIPTION OF THE ACCOMPANYING DRAWINGS

DESCRIPTION OF THE EMBODIMENTS

Figure 1A:
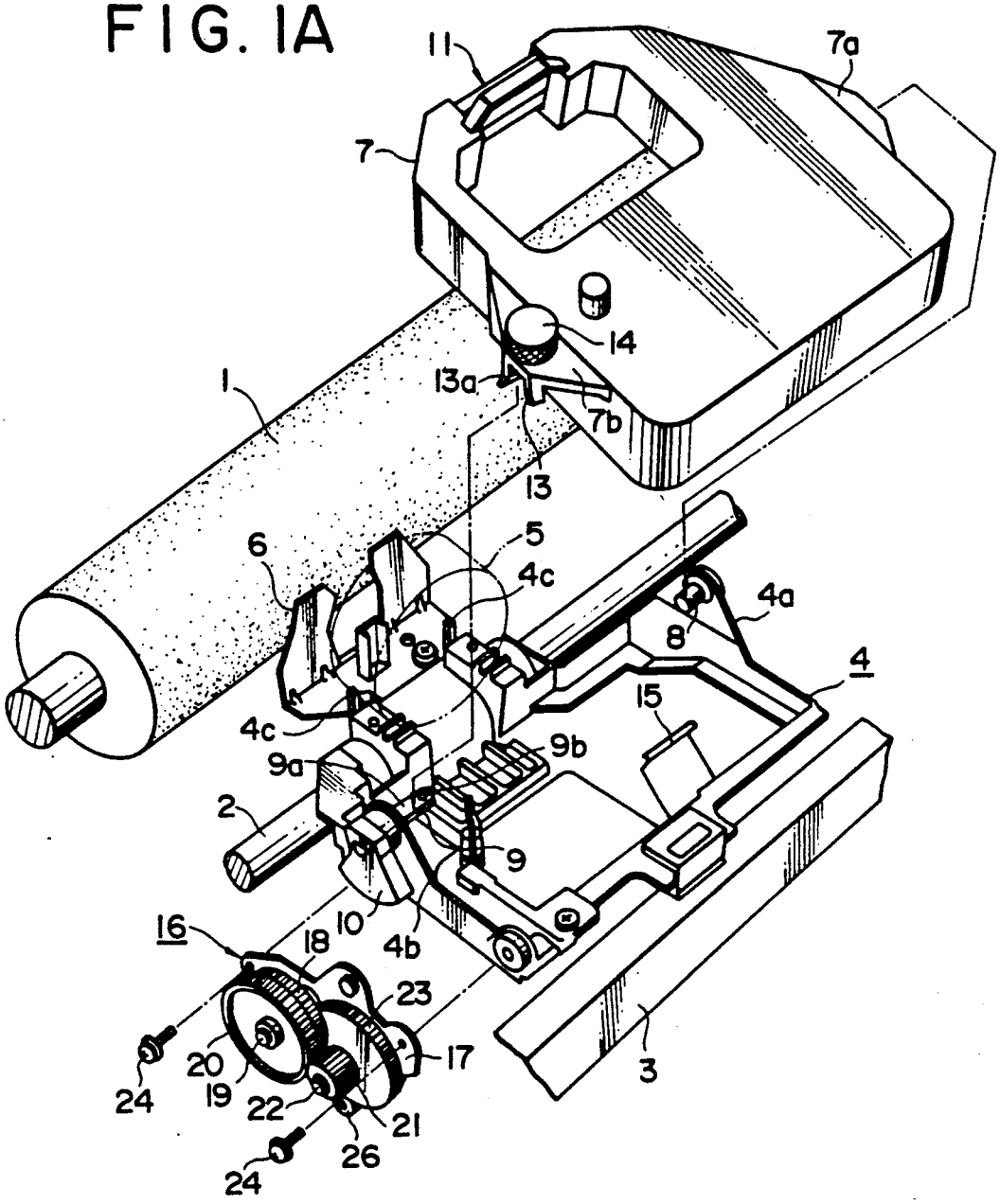
FIG. 1A is an exploded perspective view showing a rocking mechanism according to the present invention.

Referring to the drawings, an embodiment where a rocking mechanism according to the present invention is used in a color printer is described hereinafter.

As shown in FIG. 1A, on one side of a platen 1 rotatably supported by a printer frame, not shown, a guide shaft 2 and a guide rail 3 are disposed in parallel, a carriage 4 being supported by the guide shaft 2 and the guide rail 3, the carriage 4 being reciprocally movable.

On the side of the platen 1 of the carriage 4, a printing head 5 is secured and a ribbon guide 6 is mounted. On both walls **4*a* and 4*b* of the carriage 4, a pair of rocking shafts 8 and 9 are supported, the rocking shafts 8 and 9 attachably and detachably supporting a multiple zones ribbon cassette 7 and the multiple zones ribbon cassette 7 being rocked about the rocking shafts 8 and 9, the end sides of the rocking shafts 8 and 9 facing the inside of the carriage 4. The first rocking shaft 8 shown in the right side of FIG. 1A is in a cylindrical shape. The second rocking shaft 9 shown on the left side of the drawing has a fitting surface 9*a* where part of the periphery surface of the cylinder is removed. At the end of the second rocking shaft 9, a female thread 9*b* is formed. On the base side of the second rocking shaft 9, a fan shaped operation gear 10** is secured.

Figure 1B:
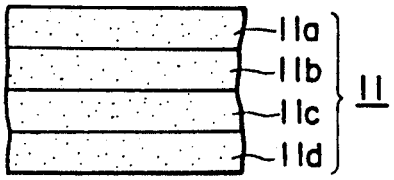
FIG. 1B is a front view showing part of multiple zones ribbon mounted on a ribbon cassette to be provided on the rocking mechanism of FIG. 1A.
Figure 2A:
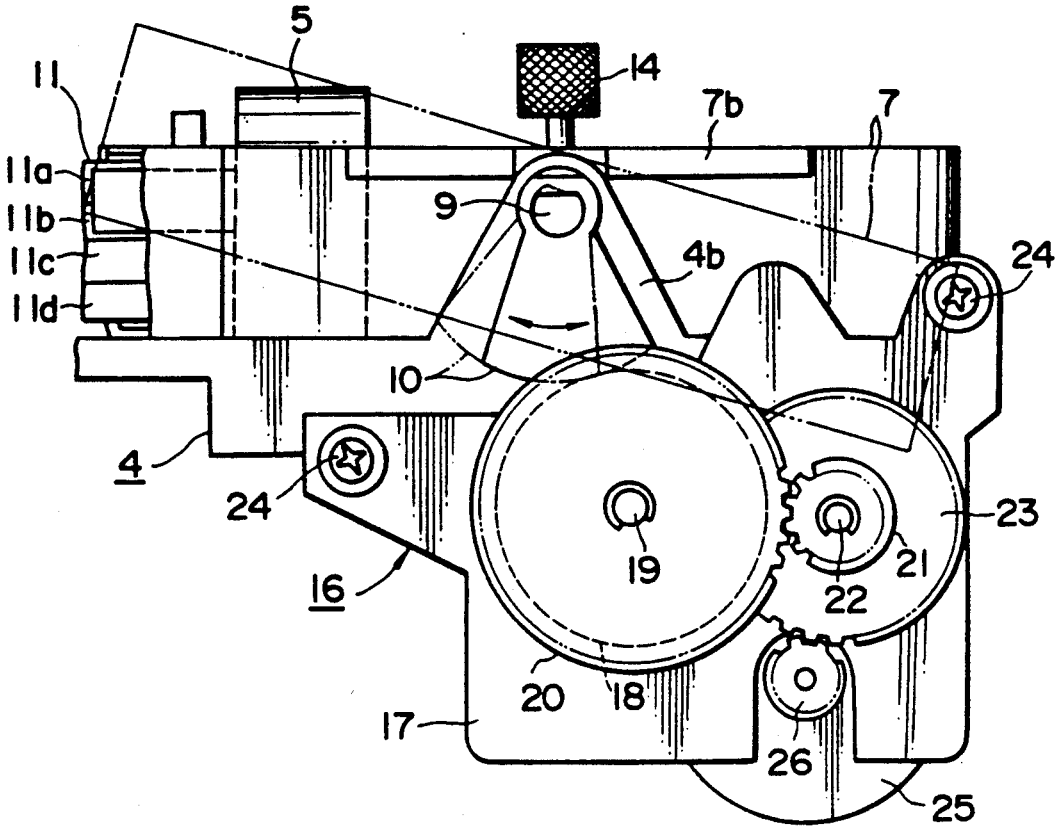
FIG. 2A is a fragmentary sectional view showing a rocking mechanism of FIG. 1A.

The multiple zones ribbon cassette 7 houses most of a multiple zones printing ribbon 11 where a plurality of printing areas **11*a*, 11*b*, 11*c*, and 11*d* are disposed in a width direction in parallel as shown in FIG. 1B. The multiple zones ribbon cassette 7 movably exposes part of the multiple zones printing ribbon 11 as shown in FIG. 1A and 2A. The multiple zones printing ribbon 11 is a color printing ribbon where different colors are disposed in the printing zones 11***a* through 11*d*.

Figure 3A:
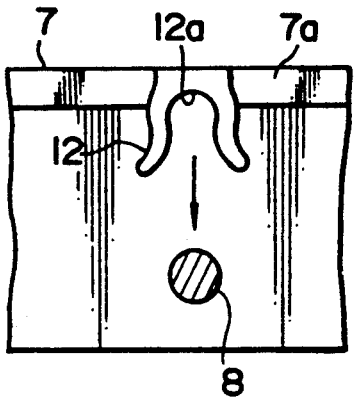
FIGS. 3A and 3B are sectional views showing engagement portions of the ribbon cassette and the shaft of FIG. 1A.
Figure 3B:
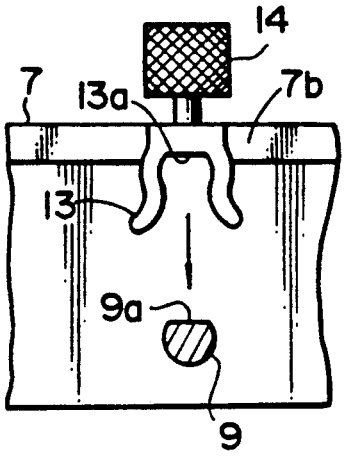

To mount the multiple zones ribbon cassette 7 on the carriage 4, flanges 7*a* and 7*b* which are protruded from the side thereof are disposed on both the sides of the multiple zones ribbon cassette 7. As shown in FIGS. 3A and 3B, both the flanges 7*a* and 7*b* are provided with a first bearing 12 and a second bearing 13 whose lower sides are open and which are downwardly protruded, the flanges 7*a* and 7*b* being engaged with the rocking shafts 8 and 9, respectively. An engagement surface 12*a* of the first bearing 12 engaged to the first rocking shaft 8 is in an arc shape. On the other hand, an engagement surface 13*a* of the second bearing 13 engaged to the second rocking shaft 9 is in a plain shape, the engagement surface 13*a* forms a fitting section which can be fit to a fitting surface 9*a* of the second rocking shaft 9.

As shown in FIGS. 1A and 2A, the flange 7*b* is provided with a set screw 14 which is secured to the female thread 9*b* of the second rocking shaft 9. By screwing the set screw 14 to the female thread 9*b* while the first bearing 12 and the second bearing 13 are engaged with the first rocking shaft 8 and the second rocking shaft 9, the multiple zones ribbon cassette 7 is secured to the second rocking shaft 9.

As shown in FIG. 1A, adjacent to the printing head 5, the carriage 4 is provided with a pair of extrusion sections 4*c* upwardly extruded for being capable of fitting the multiple zones ribbon cassette 7 to the bottom wall thereof. On the side of the guide rail 3, the carriage 4 is provided with a plate spring 15 which is fit to the bottom wall of the multiple zones ribbon cassette 7 and which is upwardly tensioned when the multiple area ribbon cassette 7 is attached.

Figure 2B:
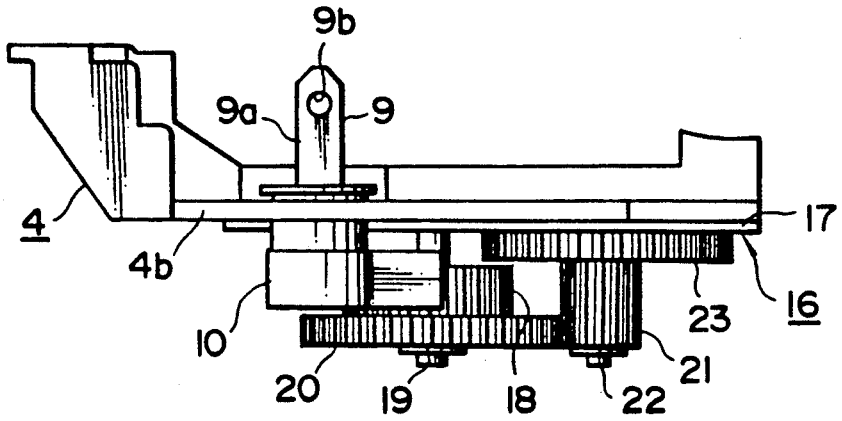
FIG. 2B is a sectional top view showing a rocking shaft and a gear unit for driving the shaft utilized in the rocking mechanism of FIG. 1A.

To rock the multiple zones ribbon cassette 7 attached on the carriage 4, the carriage 4 is provided with a gear unit 16 according to the operation gear 10. As shown in FIGS. 1A and 2B, the gear unit 16 is provided with a supporting plate 17. The supporting plate 17 is rotatably provided with a first gear 18 engaged with the operation gear 10 via a supporting shaft 19. On the supporting shaft 19, a second gear 20 rotatable along with the first gear 18 is mounted. On the supporting plate 17, a third gear 21 which is engaged with the second gear 20 is rotatably mounted via a supporting shaft 22. On the supporting shaft 22, a fourth gear 23 whose diameter is larger than that of the third gear 21 and which is rotatable along with the third gear 21 is mounted. The gear unit 16 structured above is secured to the side wall 4*b* of the carriage 4 with a screw 24 as shown in FIG. 1A.

On the other hand, as shown in FIG. 2A, a drive motor 25 which rotates forward or backward is secured to the carriage 4. While the gear unit 16 is secured to the carriage 4, a motor gear 26 of the drive motor 25 is engaged with the fourth gear 23 and the motion is connected.

A rocking mechanism is structured by the second rocking shaft 9, the operation gear 10, the gear unit 16, the drive motor 25, and so forth.

Therefore, in the multiple zones ribbon cassette 7, the fitting surface 9*a* of the second rocking shaft 9 is fit to the engagement surface 13*a* of the second bearing 13 and the multiple zones ribbon cassette 7 is supported about the first rocking shaft 8 and the second rocking shaft 9. By screwing the set screw 14 to the female thread 9*b* of the second rocking shaft 9, the multiple zones ribbon cassette 7 is prevented from being removed.

In this state, the bottom wall of the multiple zones ribbon cassette 7 is fit to the two extrusion sections 4*c* and the plate spring 15 disposed on the carriage 4. By the spring tension of the plate spring 15, the multiple zones ribbon cassette 7 is rotatably tensioned in the counterclockwise direction of FIG. 2A about the first rocking shaft 8 and the second rocking shaft 9, whereby the multiple zones ribbon cassette 7 is horizontally kept. While the multiple zones ribbon cassette 7 is horizontally kept, the printing zone 11*a*, which is in the highest position of the multiple zones printing ribbon, is placed in the printing position.

Figure 4:
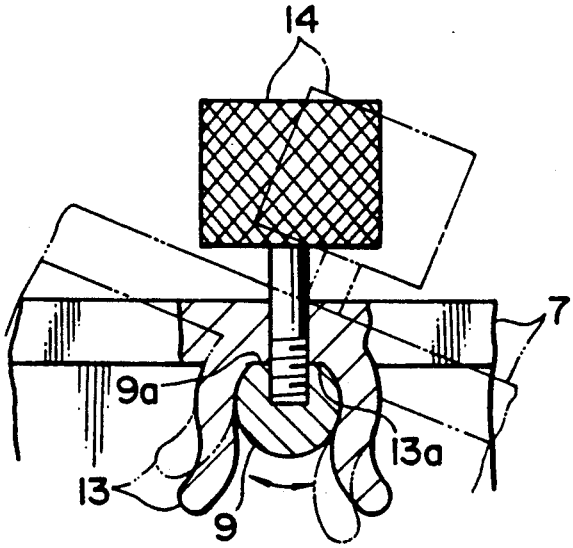
FIG. 4 is a sectional view explaining an engagement operation between the ribbon cassette and the shaft.

In this horizontal state, by operating the drive motor 25 and reciprocating the operation gear 10 via the motor gear 26, the fourth gear 23, the third gear 21, the second gear 20, and the first gear 18 as shown with the solid line and the two-dot-line of FIGS. 2A and FIG. 4, the second rocking shaft 9 is rocked in a vertical direction. Thereby, the multiple zones ribbon cassette 7 is rocked about the first rocking shaft 8 and the second rocking shaft 9 as shown with the solid line and the two-dot-line in FIGS. 2A and 4. Thus, one of the printing zones 11*a* through 11*d* of the multiple zones printing ribbon 11 is selectively placed in the printing position.

By selectively placing one of the printing zones 11*a* through 11*d* in the printing position and by activating the printing head 5, data is printed in colors according to the selected zones of the printing zones 11*a* through 11*d*.

Figure 5A:
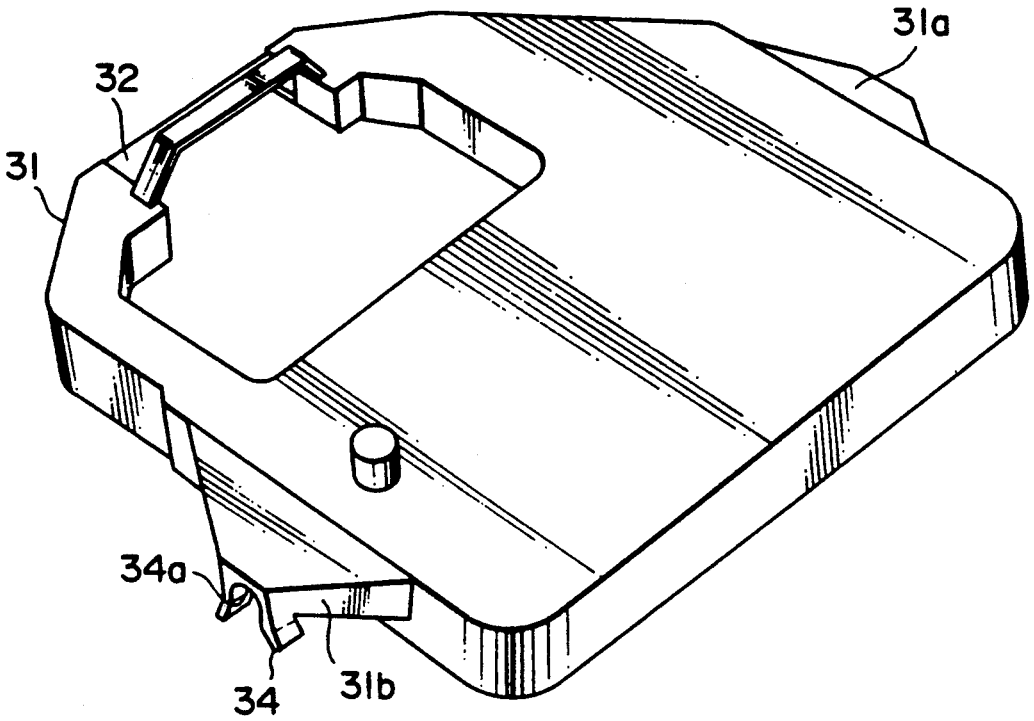
FIG. 5A is a perspective view showing a single zone ribbon cassette employed in a rocking mechanism according to the present invention.
Figure 5B:
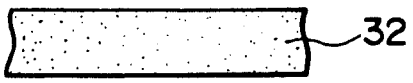
FIG. 5B is a front view showing part of single zone ribbon mounted on the ribbon cassette of FIG. 5A.
Figure 6:
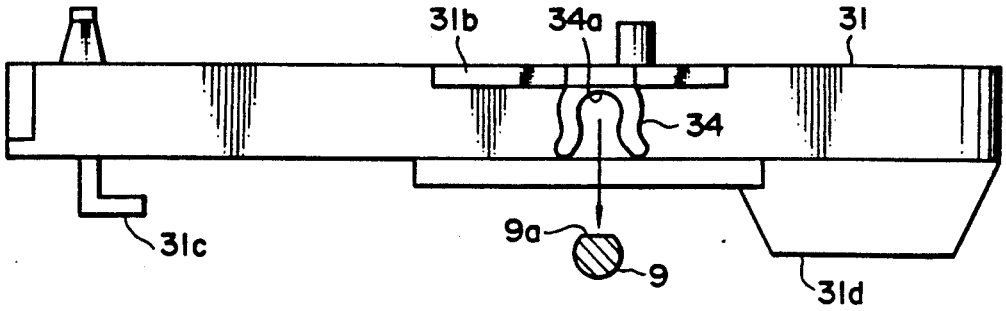
FIG. 6 is a sectional view showing the single zone ribbon cassette of FIG. 5A.

In addition, the above rocking mechanism is capable of providing a single zone ribbon cassette 31 shown in FIGS. 5A and 6 besides the multiple zones ribbon cassette 7. As shown in FIG. 5B, the single zone ribbon cassette 31 houses the single zone printing ribbon 32 having a single area, namely, single printing color. Part of the single zone printing ribbon housed in the single zone ribbon cassette is exposed such as the multiple zones ribbon cassette.

Figure 7A:
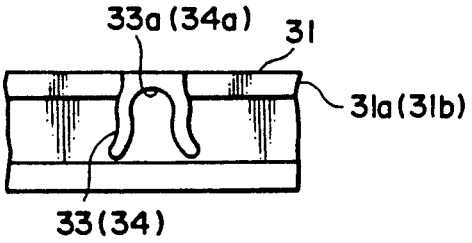
FIGS. 7A and 7B are sectional views showing engagement portions when the ribbon cassette of FIG. 5A is provided on the rocking mechanism of FIG. 1A.
Figure 7B:
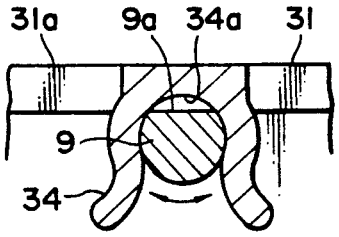

In addition, the flanges 31*a* and 31*b* are extruded to both the sides of the single zone ribbon cassette 31 so as to engage the single area ribbon cassette 31 to the carriage 4. As shown in FIGS. 7A and 7B, the first bearing 33 and the second bearing 34 are downwardly extruded from both the flanges 31*a* and 31*b*, the first bearing 33 and the second bearing 34 having open sections so that they are engaged to the first rocking shafts 8 and the second rocking shaft 9 from the upper direction thereof.

In the present embodiment, the engagement surfaces 33*a* and 33*b* of the first bearing 33 and the second bearing 34 are in arc shapes. Unlike the multiple zones ribbon cassette 7, the single zone ribbon cassette 31 has the arc-shaped engagement surface 34*a* of the second bearing 34. The engagement surface 34*a* forms a protection section for protecting the engagement surface 34*a* from being fit to the fitting surface 9*a* of the second rocking shaft 9. In other words, while the second rocking shaft 9 and the second bearing 34 can be mutually rotated, they are engaged.

On the other hand, as shown in FIG. 6, the fitting section 31*c*, which can be fit to the extrusion section 4*c* while the single area ribbon cassette 31 is mounted on the carriage 4, and another fitting section 31*d*, which can be fit to the plate spring 15, are downwardly extruded on the bottom wall of the single zone ribbon cassette 31. In other words, the fitting sections 31*c* and 31*d* are extruded so as to cause the single zone ribbon cassette 31 whose height is lower than that of the multiple zones ribbon cassette 7 to be horizontally kept like the multiple zones ribbon cassette 7.

In this state, the fitting sections 31*c* and 31*d* on the bottom wall of the single ribbon cassette 31 are fit to the extrusion sections 4*c* and the plate spring 15, the tension force of the plate spring 15 causing the single zone ribbon cassette 31 to be rotatably tensioned in the counterclockwise direction of FIG. 6 about the first rocking shaft 8 and the second rocking shaft 9, whereby the single zone ribbon cassette 31 is horizontally kept. While the single zone ribbon cassette 31 is horizontally kept, the single zone printing ribbon 32 is placed at the printing position.

While the single zone ribbon cassette 31 is horizontally kept, the operation gear 10 is reciprocated via the motor gear 26, the fourth gear 23, the third gear 21, the second gear 20, and the first gear 18 according to the motion of the drive motor 25. At this time, even if the second rocking shaft 9 is rocked as shown with the solid line and the two-dot line of FIG. 7B, the single zone ribbon cassette 31 is not accordingly rocked since an inner surface of the second bearing 34 and a circumferential surface of the second rocking shaft 9 slip with respect to each other.

Thus, while the single zone ribbon cassette 31 is mounted, even if color printing data is mistakenly output and printed out, the single area ribbon cassette 31 is not rocked. Thereby, the data can be output in the condition that the single zone printing ribbon 32 is always placed at the printing position. Therefor, the printing data can be prevented from being lost.

Consequently, using this rocking mechanism, even if the single zone ribbon cassette 31 is mounted instead of the multiple zones ribbon cassette 7, data can be normally printed out.

The present invention is not limited to the embodiment described above. In the range of the spirit of the invention, part of the structure thereof can be changed and the invention can be embodied as follows.

Figure 8A:
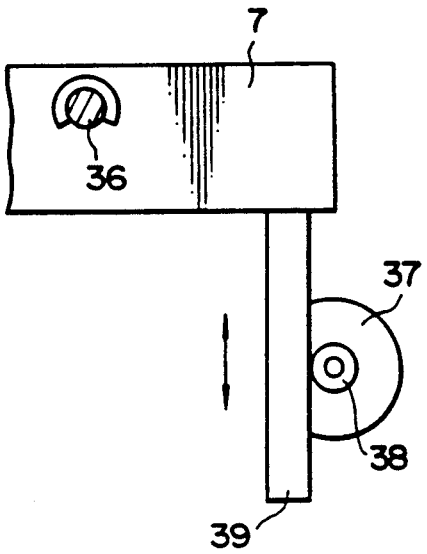
FIGS. 8A and 8B are sectional views showing an another embodiment of the rocking mechanism according to the present invention.
Figure 8B:
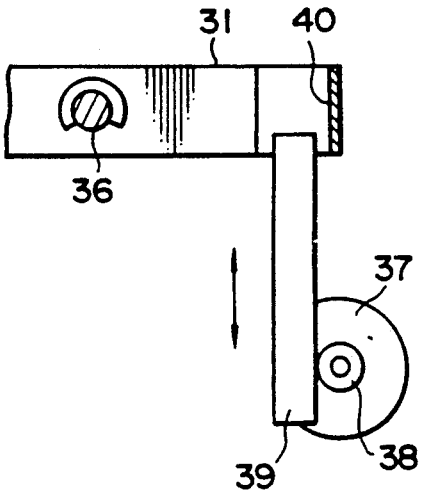

(1) In the above embodiment, against the fitting surface 9*a* disposed on the second rocking shaft 9, the flat engagement surface 13*a*, which can be fit to the fitting surface 9*a*, is disposed on the second bearing 13 of the multiple zones ribbon cassette 7, the arc engagement surface 9*c* for preventing the fitting surface 9*a* from being fit being disposed on the second bearing 34 of the single zone ribbon cassette 31. However, as shown in FIGS. 8A and 8B, it is possible to embody the present invention in the following structure. The multiple zones ribbon cassette 7 and the single zone ribbon cassette 31 are respectively arranged to be supported with a rocking support shaft 36. A rocking mechanism composed of a pinion 38 driven by a drive motor 37 reversely rotatable and a rack 39 vertically moved by the engagement with the pinion 38 is disposed. The bottom wall of the multiple zones ribbon cassette 7 is disposed above the rack 39 as the fitting section. The single zone ribbon cassette 31 may be provided with the cut section 40 for preventing the rack 39 from being contacted thereto.

Figure 9A:
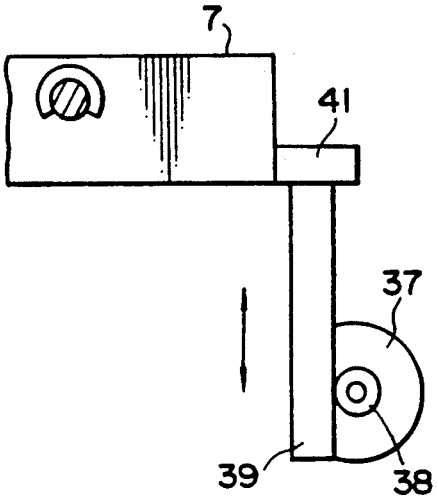
FIGS. 9A and 9B are sectional views showing a still another embodiment of the rocking mechanism according to the present invention.
Figure 9B:
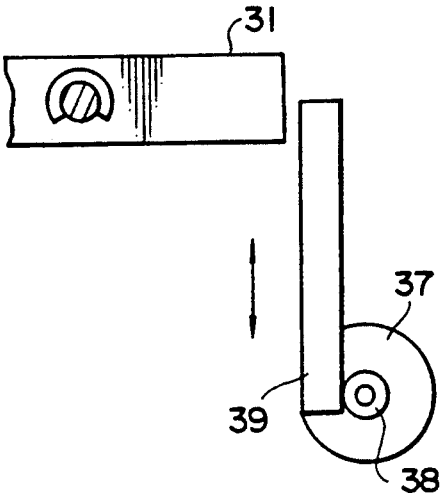

(2) In addition, as shown in FIGS. 9A and 9B, the fitting section 41 is protruded from the rear of the multiple zones ribbon cassette 7, the fitting section 41 being contacted to the upper end of the rack 39. The rear section of the single zone ribbon cassette 31 can be shortened so as to provide the protection section for protecting the rack 39 from being fit thereto.

In the embodiment described above, the multiple zones ribbon cassette 7, which houses the multiple zones printing ribbon 11, where different printing colors are disposed in a width direction in parallel, is provided for a color printer. However, it is also possible to embody a multiple zones ribbon cassette housing a multiple zones printing ribbon using a single zone.

What is claimed is:

1. A rocking mechanism, adapted to be positioned in a printing device for rocking a ribbon cassette mounting a print ribbon, said ribbon being provided with a number of longitudinally extending print zones comprising at least one, said rocking mechanism comprising:

a drive member for driving said ribbon cassette to be rocked in a vertical direction; and a transmit control portion, provided on said ribbon cassette, for transmitting a driving force of said drive member to said ribbon cassette to rock said cassette, while inhibiting said transmission in case that said number of said print zones provided on said print ribbon is a predetermined value whereby said driving force is not transmitted to said cassette so that said cassette is not rocked.

2. The rocking mechanism according to claim 1, wherein said predetermined value is one.

3. The rocking mechanism according to claim 1, wherein said drive member comprises a shaft member, adapted to be rotated in case that said ribbon cassette is to be rocked, for holding said ribbon cassette an wherein said transmit control portion comprises an engagement portion adapted to be brought into engagement with said shaft member and a disengagement portion adjacently provided with said engagement portion, said disengagement portion being provided in case that a number of print zone provided on said print ribbon is said predetermined value, whereby said ribbon cassette is not rocked with a rotation of said shaft member in case that said disengagement portion is provided on said ribbon cassette.

4. The rocking mechanism according to claim 3, which further comprises a connect member provided on said ribbon cassette for mechanically connecting said ribbon cassette and said shaft member with each other.

5. The rocking mechanism according to claim 4 wherein said connect member comprises a screw member a screw member having a threaded portion which is adapted to be brought into engagement with a predetermined portion of said shaft member.

6. The rocking mechanism according to claim 1, wherein said drive member comprises a rack vertically movable and a pinion adapted to be brought into engagement with said lack, and wherein said transmit control portion comprises a contact portion adapted to be brought into contact with said rack in case that a number of the print zone is not said predetermined value.

7. A ribbon cassette, for holding a single printing zone ribbon which provides one printing zone in a width direction, adapted to be positioned in a printing device including a rocking mechanism for rocking a ribbon cassette which is mounted on said printing device in the width direction, said ribbon cassette comprises an engagement portion for engaging said ribbon cassette and said rocking mechanism with a control portion for controlling said ribbon cassette so as not to be rocked when said rocking mechanism is operated.

8. The ribbon cassette according to claim 7, wherein said control portion comprises a release portion for releasing an engagement of said ribbon cassette and said rocking mechanism.

* * * * *